US009375774B1

(12) United States Patent
Watkins et al.

(10) Patent No.: US 9,375,774 B1
(45) Date of Patent: Jun. 28, 2016

(54) CONTAINER BODY FORMING APPARATUS AND METHOD

(71) Applicant: Evergreen Packaging Technology, LLC, Arvada, CO (US)

(72) Inventors: Evan D. Watkins, Evergreen, CO (US); Michael Atkinson, Lafayette, CO (US); James Hunnel, Denver, CO (US)

(73) Assignee: Aleco Container LLC, Arvada, CO (US)

( * ) Notice: Subject to any disclaimer, the term of this patent is extended or adjusted under 35 U.S.C. 154(b) by 325 days.

(21) Appl. No.: 13/948,019

(22) Filed: Jul. 22, 2013

Related U.S. Application Data

(60) Provisional application No. 61/675,306, filed on Jul. 24, 2012, provisional application No. 61/675,697, filed on Jul. 25, 2012.

(51) Int. Cl.
*B21D 22/24* (2006.01)
*B21D 22/28* (2006.01)
*B21D 22/30* (2006.01)

(52) U.S. Cl.
CPC ..... *B21D 22/28* (2013.01); *B21D 22/24* (2013.01); *B21D 22/30* (2013.01)

(58) Field of Classification Search
CPC ..... B21D 22/20; B21D 22/22; B21D 22/24; B21D 22/28; B21D 22/21; B21D 22/283; B21D 22/30; B21D 24/005; B21D 51/2669
See application file for complete search history.

(56) References Cited

U.S. PATENT DOCUMENTS

| | | | | |
|---|---|---|---|---|
| 3,696,657 A | | 10/1972 | Maytag | |
| 4,166,372 A | * | 9/1979 | Knight | 72/348 |
| 4,541,265 A | * | 9/1985 | Dye | B21D 22/28 72/347 |
| 4,696,177 A | * | 9/1987 | Bulso, Jr. | B21D 22/24 72/379.4 |
| 4,732,031 A | * | 3/1988 | Bulso et al. | 72/363 |
| 4,934,167 A | | 6/1990 | Grims et al. | |
| 5,761,949 A | * | 6/1998 | Dalessandro et al. | 72/325 |

OTHER PUBLICATIONS

Atkinson, Michael; Watkins, Evan D.; Kelley, Donna; Hunnel, James, U.S. Appl. No. 13/947,972, filed Jul. 22, 2013 for "Container Body Trimming Apparatus and Method," 37 pages.

* cited by examiner

*Primary Examiner* — Teresa M Ekiert
(74) *Attorney, Agent, or Firm* — William P. O'Meara; Klaas, Law, O'Meara & Malkin, P.C.

(57) ABSTRACT

A machine may include a plurality of stations for converting a portion of flat sheet metal stock into a cylindrical container body having an open end and an oppositely disposed closed end. The machine may include a first station adapted to blank and draw a portion of flat sheet metal stock into a cup, a second station adapted to reverse draw the cup into an elongated cylinder; and a third station adapted to reverse draw and iron the elongated cylinder into the cylindrical container body.

17 Claims, 10 Drawing Sheets

CONTAINER BODY FORMING APPARATUS AND METHOD

This application is related to U.S. Patent application Ser. No. 61/675,697 filed Jul. 25, 2012, entitled CONTAINER BODY TRIMMING APPARATUS AND METHOD, which is hereby incorporated by reference for all that it discloses. This application claims the benefit of U.S. Provisional Application No. 61/675,306 filed Jul. 24, 2013 for CONTAINER BODY FORMING APPARATUS AND METHOD, which is hereby incorporated by reference for all that it discloses.

BACKGROUND

A can body making apparatus is described in Maytag, U.S. Pat. No. 3,696,657, which is hereby incorporated herein by reference for all that it discloses. In this patent, a ram carriage and redraw carriage are each mounted on rollers which move over carriage way strips. Each pair of upper and lower rollers are urged toward each other so as to be in firm contact with the carriage way strip located therebetween. Both the ram and redraw carriages are reciprocated at rates sufficient to form about two hundred cans a minute. The constant reciprocal movement of the ram and redraw carriages and the tight engagement of the rollers on the carriage way strips result in wear which may cause misalignment of the ram or of the can blanks by the redraw sleeve.

Grims et al., U.S. Pat. No. 4,934,167, which is hereby incorporated by reference for all that it discloses, describes a can body making apparatus having an elongated ram which is connected to apparatus for producing straight line reciprocating motion and which is supported solely by a liquid bearing during the reciprocation thereof.

DETAILED DESCRIPTION

Figure 1:
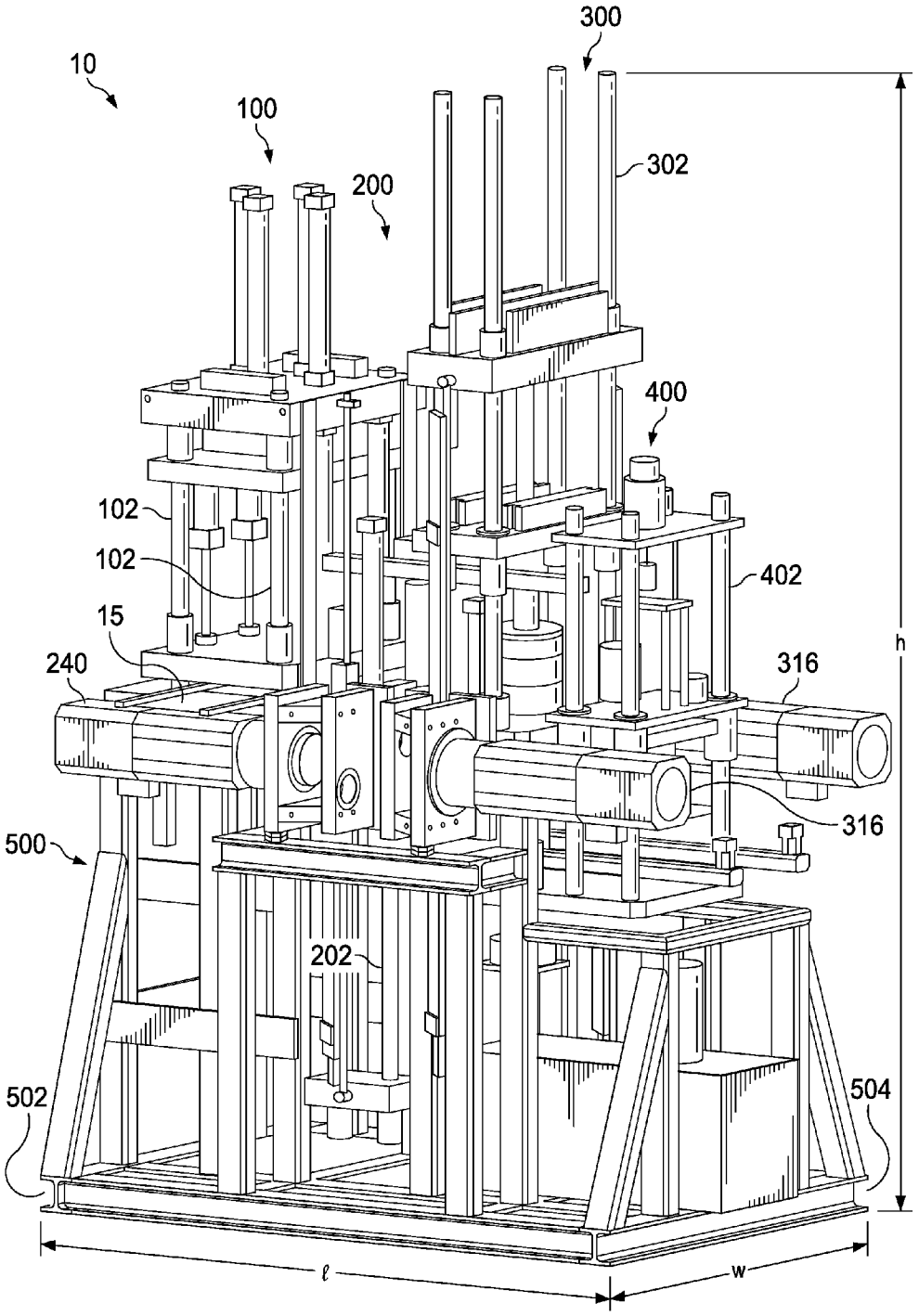
FIG. 1 is a front perspective view of an example container body forming apparatus.
Figure 2:
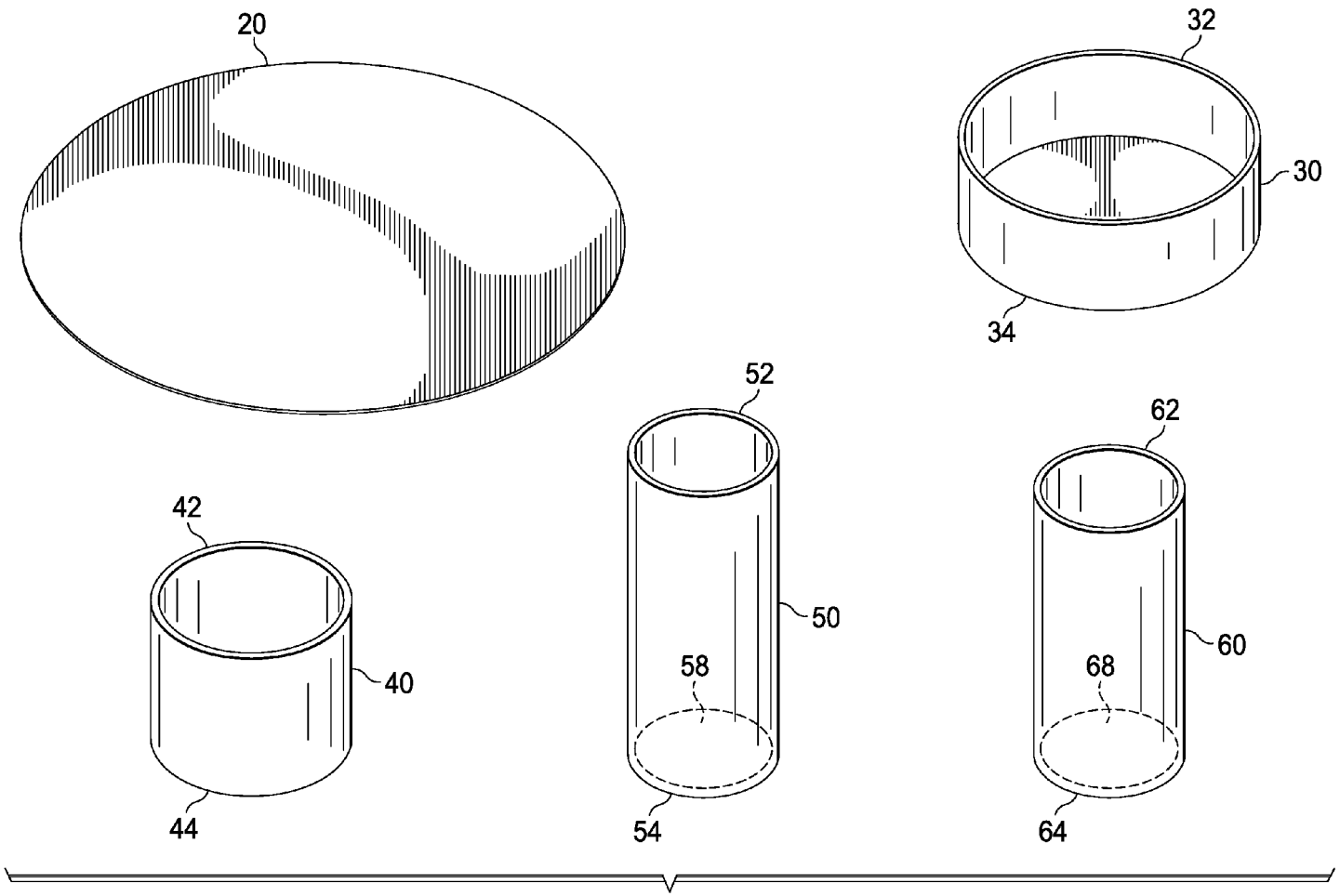
FIG. 2 is a perspective view illustrating various stages of container body formation which may be produced by the container body forming apparatus of FIG. 1

FIG. 1 illustrates an example embodiment of a container body forming apparatus 10. In general terms, the container body forming apparatus 10 uses hydraulic cylinders, servo motor driven rack and pinion and servo motor driven ball screw technology to provide the motion for blanking, drawing, ironing and trimming raw material (e.g., flat metal sheet stock 15) into an extruded cylindrical container body 60 for use in forming containers to hold many different types of substances. The forming process includes the formation of the following, as shown by FIG. 2: a disc 20; a shallow cup 30 having an open top edge portion 32 and a closed bottom portion 34; a drawn medium length cylinder 40 having an open top edge portion 42 and a closed bottom portion 44; a drawn and ironed container body 50 having an open top edge portion 52 and a closed bottom portion 54; and a trimmed container body 60 having an open top edge portion 62 and a closed bottom portion 64. In some embodiments the bottom portions 54, 64 may have a conventional dome shape 58, 68.

Figure 3:
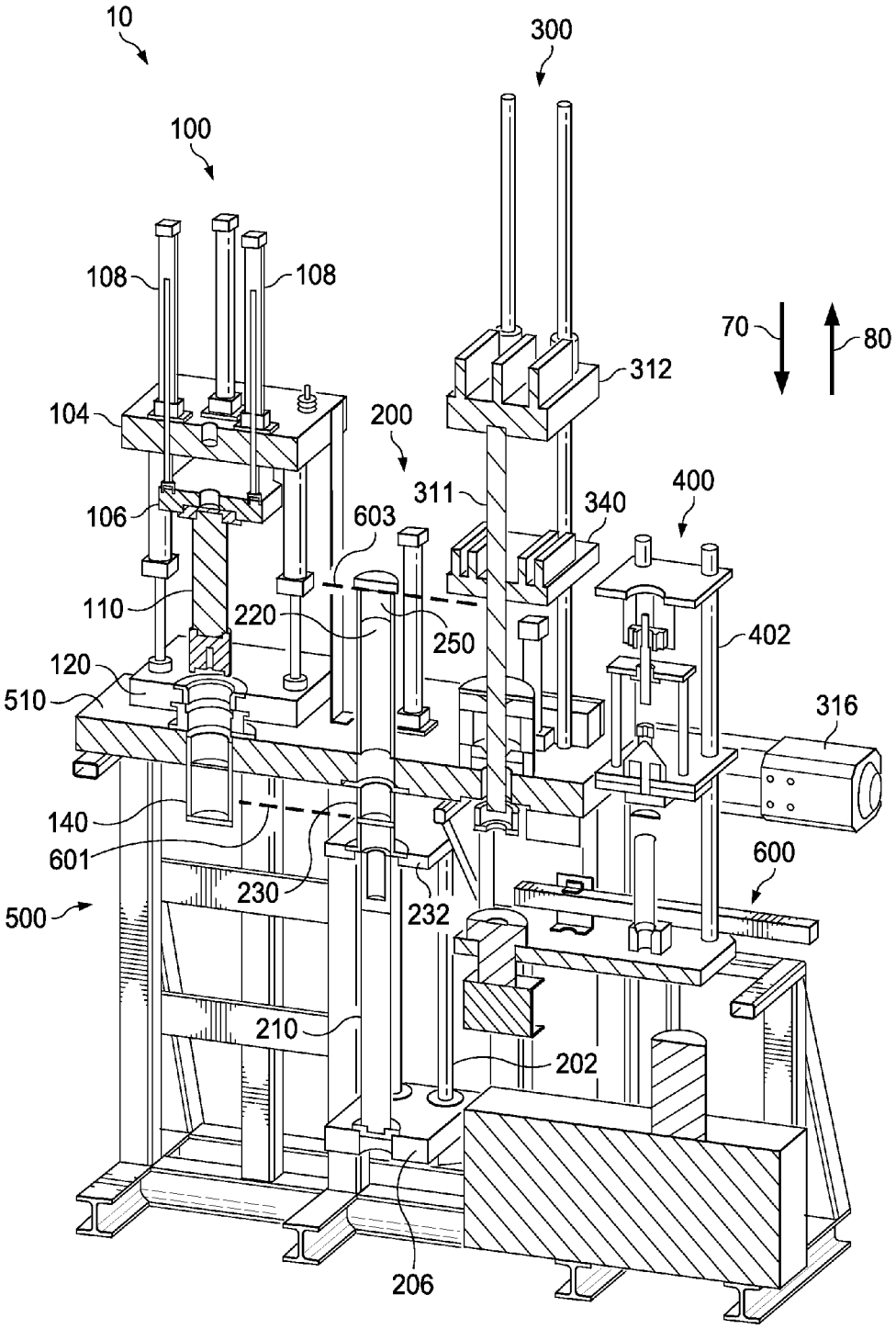
FIG. 3 is a front cross sectional perspective view showing a series of example stages in the example container body forming apparatus of FIG. 1.
Figure 4:
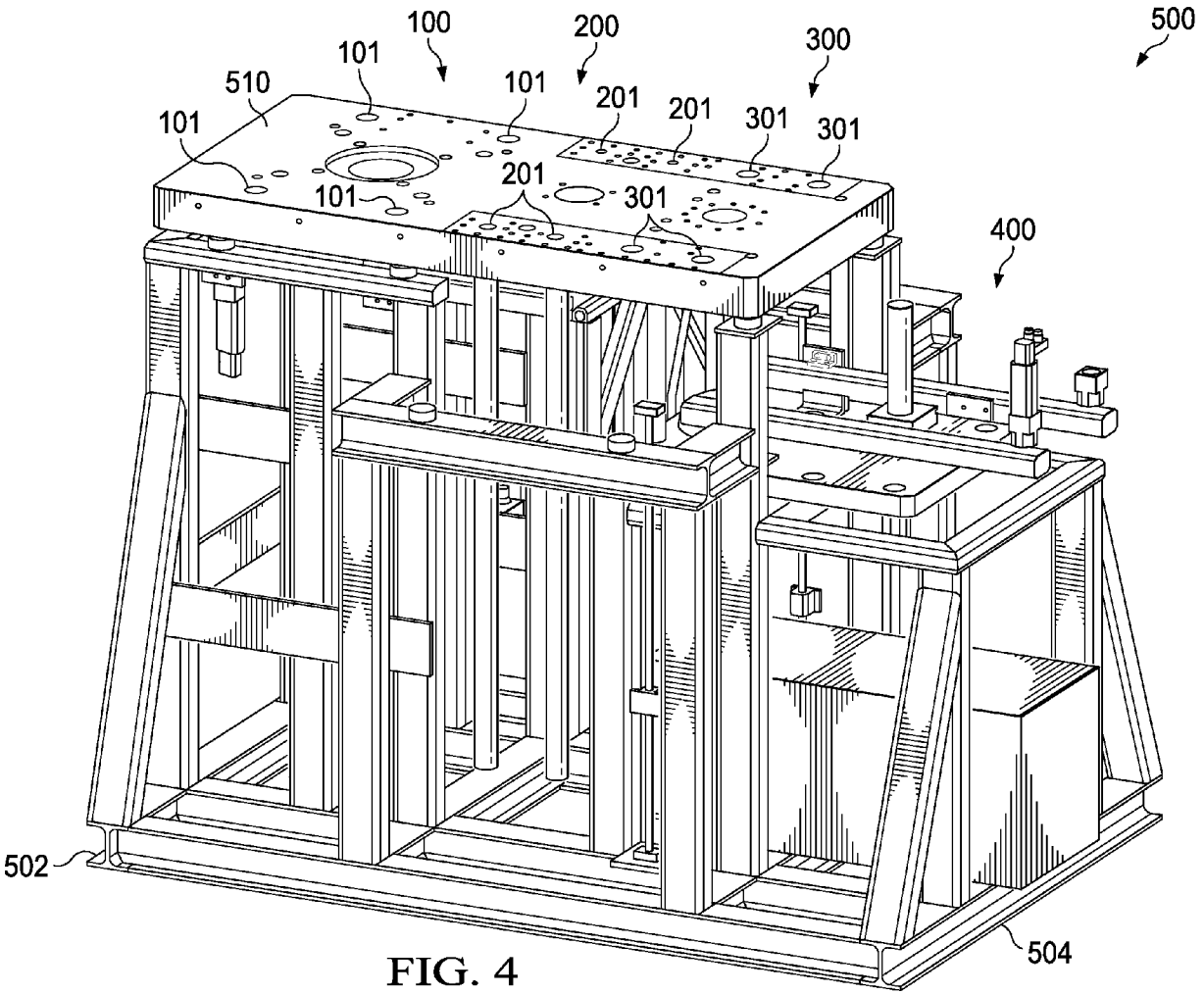
FIG. 4 is front perspective view of a support structure of the example container body forming apparatus of FIG. 1.

The container body forming apparatus 10 may include multiple stages. With reference to FIGS. 1 and 3, the first stage 100 may be adapted to receive flat sheet metal stock 15. Thereafter, the first stage 100 may blank a disc 20, FIG. 2, from the flat sheet metal stock 15 and then form a shallow cup 30 from the blanked disc 20. The shallow cup 30 is transferred to the second stage 200 where the cup 30 is drawn inside out ("redrawn") to form a medium length cylinder 40, FIG. 2. The medium length cylinder 40 is transferred to the third stage 300 where it is drawn inside out ("redrawn") and ironed into a specified diameter cylinder 50, and a dome 58 may be subsequently formed in the closed bottom portion 52 thereof. The domed cylinder 50 is transferred to the fourth stage 400 where it is trimmed to a specified height to form a trimmed cylindrical container 60. Each of the stages 100, 200, 300, 400 may be attached to and supported by a common support structure 500, as best shown in FIGS. 1, 3 and 4. The stations 100, 200, 300, 400 are arranged in a series from one end 502 of the support structure 500 to the other end 504 of the support structure. The container body forming apparatus 10 may be provided in a relatively compact configuration in which all four stages are mounted on a support structure 500. In one embodiment the container forming apparatus 10 may have a length "l" of about ten feet, a width "w" of about eight feet and a height "h" of about twelve feet. The different work pieces 30, 40, 50 are linearly transferred from one station to the next by a series of linear transfer devices such as pick-and-place machines 600, shown in FIGS. 3, 9 and 10.

Figure 5:
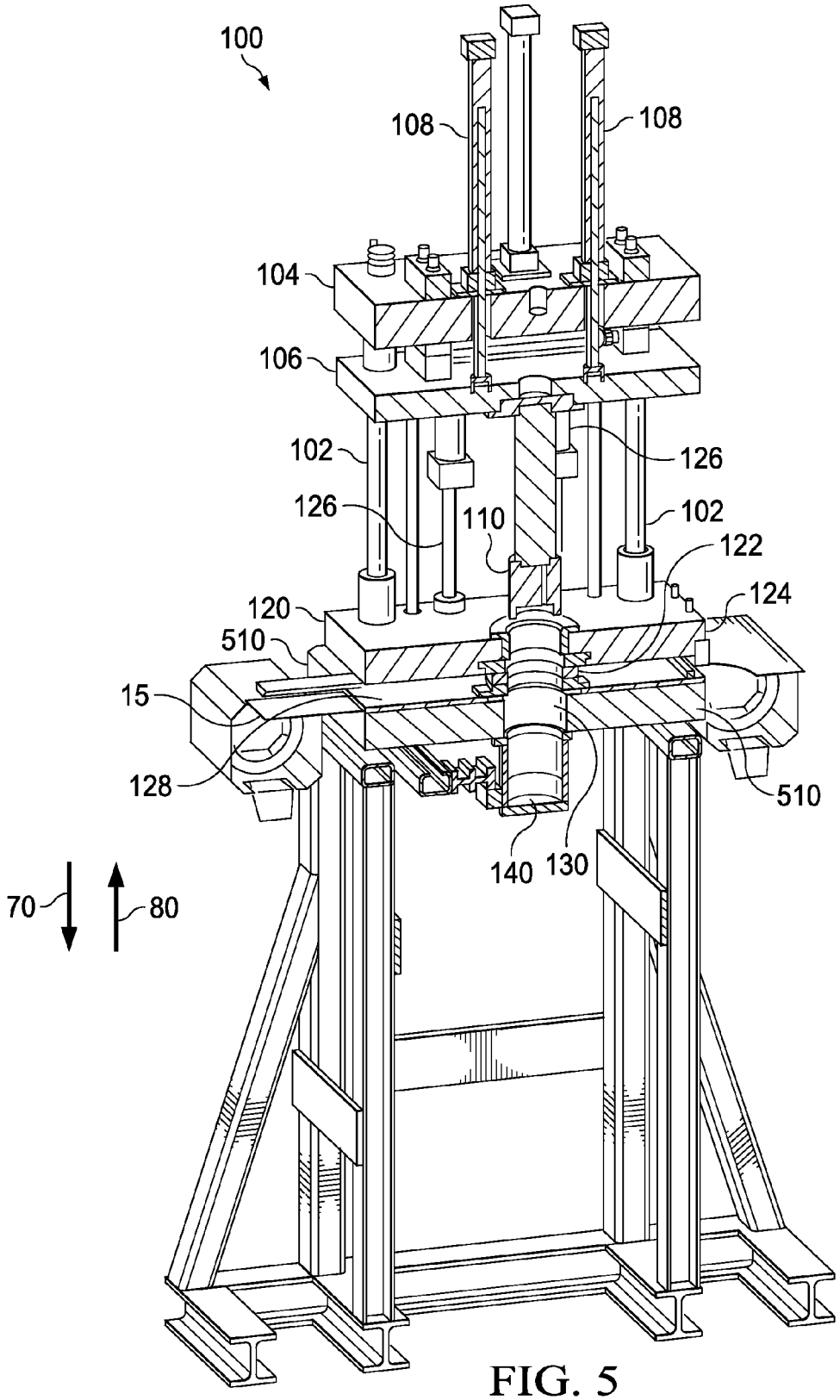
FIG. 5 is a side perspective cross-sectional detail view of the first stage of the example container body forming apparatus of FIG. 1.
Figure 6:
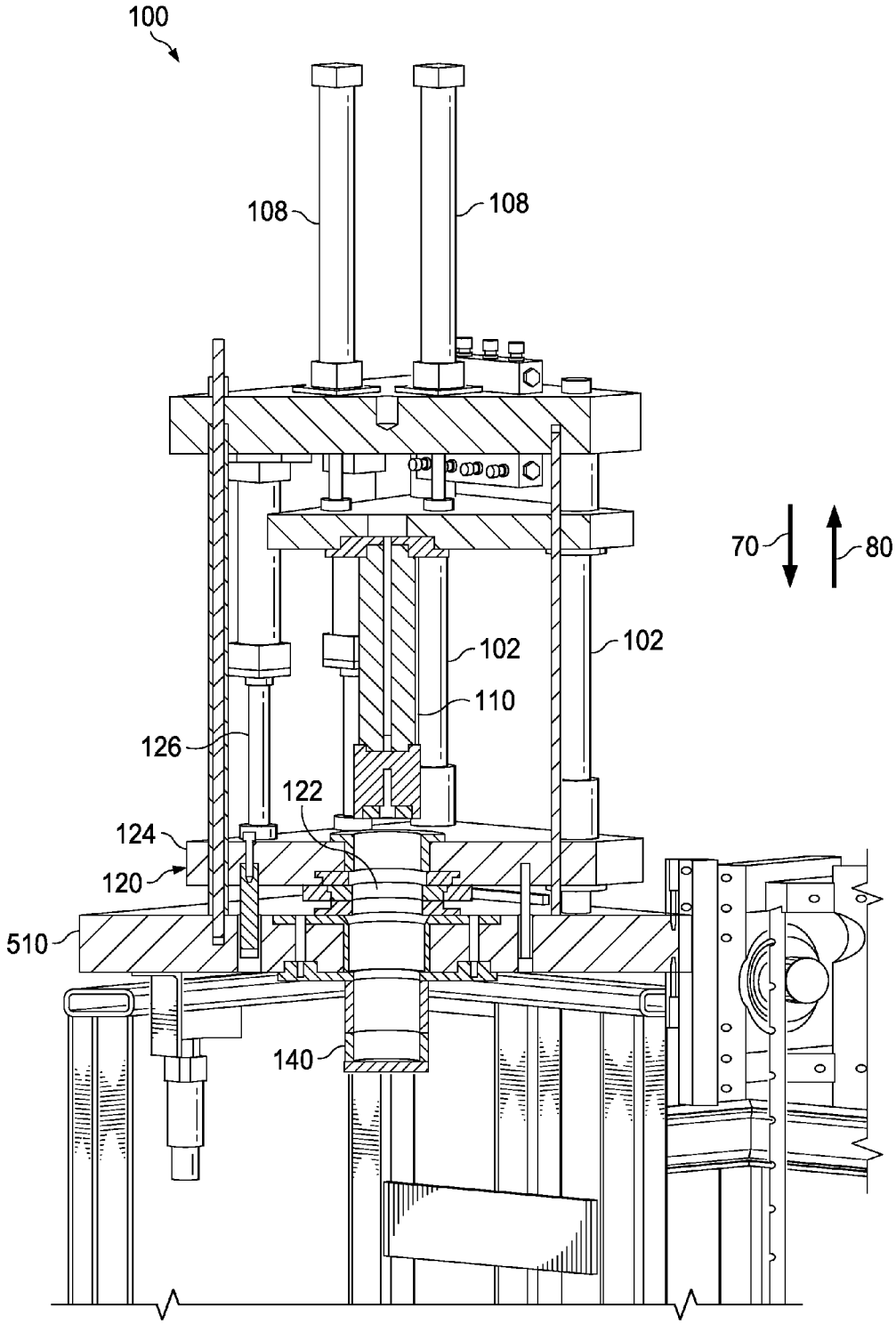
FIG. 6 is another perspective cross-sectional detail view of the first stage of the example container body forming apparatus of FIG. 1.

FIGS. 3, 5 and 6 illustrate the first stage 100 in further detail. With reference to FIGS. 3, 5 and 6, the first stage 100 may include a hydraulically actuated ram 110 and a hydraulically actuated hold down assembly 120. In operation, in general, the hold down assembly 120 is first actuated, causing an attached die 122, FIGS. 5 and 6, to cut or blank a disc 20, FIG. 2, from the flat metal sheet stock 15, FIG. 5. Next, while the hold down assembly 120 maintains a gripping force against the disc 20, the ram 110 is moved downwardly (i.e., in the direction 70), forcing the disc 20 through a forming die 130. In this manner, the first stage 100 receives flat sheet metal sheet stock 15, blanks a disc 20 out of the sheet stock 15, and draws the disc 20 into a shallow cup 30. Because the hold down assembly 120 is hydraulically actuated, the amount of hold down force supplied by the hold down assembly 120 can be varied throughout the movement of the ram 110, thus allowing a high degree of control over the metal forming process. An advantage of this arrangement is that different thicknesses of sheet stock and different types of sheet stock material can be processed by the apparatus 10 without tearing or over stressing the sheet stock. Also, tooling changes can be made relatively easily enabling production of different sized container bodies 60 with the same apparatus 10.

With reference to FIGS. 1 and 3-6, the first stage may comprise a four-post press having four vertically oriented posts 102 (only two visible in most views), that are arranged in a rectangular formation and attached at 101 to a platform member 510 of support structure 500, FIG. 4. An upper fixed plate 104 is fixedly attached to the four vertical posts 100. An upper moveable plate or ram carriage 106 is slideably mounted on the four posts 100 as by suitable bearings. The ram 110 is fixedly mounted on the ram carriage 106 and may thus be vertically displaced by displacement of the ram carriage. The ram fixed plate 104 and ram carriage 106 are operably attached to at least one linear actuator such as a set of hydraulic cylinders 108, which may be actuated to displace the ram carriage 106.

The hold down assembly 120 may comprise a lower displaceable plate 124 that is slideably mounted on vertical posts 102 by suitable bearings. A linear actuator, such as a second set of hydraulic cylinders 126 are operably attached to lower displaceable plate 124 and fixed upper plate 104 and may be actuated to vertically downwardly displace plate 124 to blank a disc 20 and then hold the disc 20 against a lower fixed plate 128, FIG. 5, during the drawing operation. The tooling used to engage and hold the blanked disc 20 may be conventional tooling known in the art and is thus not described in detail herein. After drawing is complete the hold down force is released and the cup 30, thus formed, drops to position 140, FIGS. 3, 5 and 6, where it is picked up by a linear transfer assembly, such as pick-and-place machine 600, FIG. 10 (not shown in FIGS. 3, 5 and 6). The shallow cup 30 falls to position 140 with an open top edge 32 positioned upwardly, 80, and a closed bottom edge 34 positioned downwardly, 70, and it remains in this orientation, i.e., it is not flipped over, as it is moved by the linear transfer assembly to the next station 200. The path followed by the cup 30 as it is transferred to station 200 is shown at 601 in FIG. 3.

Figure 7:
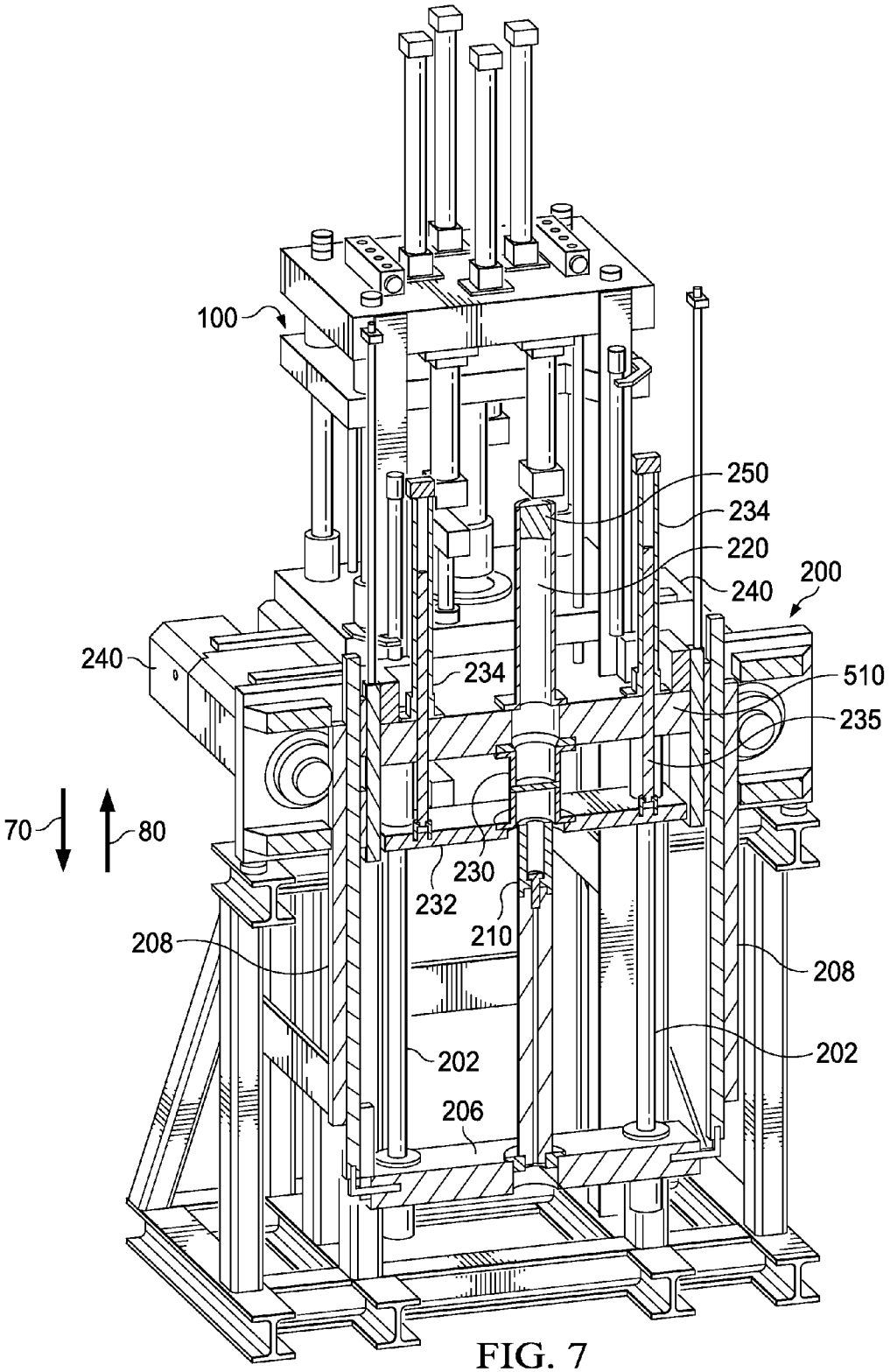
FIG. 7 is a side perspective cross-sectional detail view, looking back toward the first stage, of the second stage of the example container body forming apparatus of FIG. 1.
Figure 9:
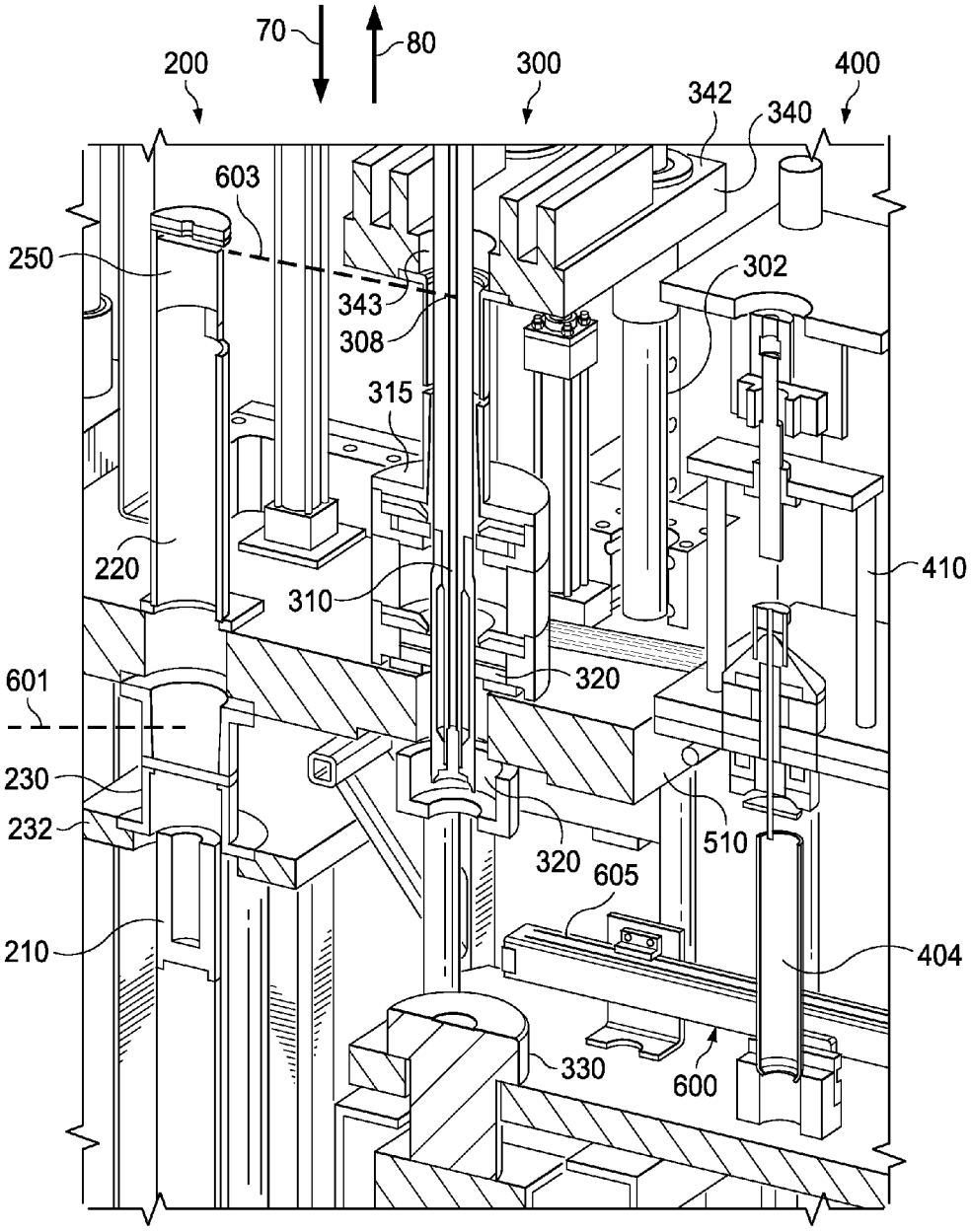
FIG. 9 is front perspective cross-sectional detail view of the second, third and fourth stages of the example container body forming apparatus of FIG. 1.

FIGS. 3, 7 and 9 best illustrate the second stage 200. FIG. 3 is a front perspective cross sectional view of the entire apparatus 100 showing the relative position of the second stage 200. FIG. 7 is a perspective cross sectional view looking back towards the first stage 100. FIG. 9 is a detail of the view of FIG. 3. With reference to FIGS. 3, 7 and 9, the second stage 200 includes a ram 210. In general, after the shallow cup 30 is formed in the first stage 100, in a manner as described above, the cup 30 may be laterally transferred to the second station 200 along path 601. The ram 210 is used to reverse draw the cup 30 into an elongated cylinder 40 having an open top edge portion 42 and a closed bottom end portion 44, as shown in FIG. 2. To perform this operation, the ram 210 in the illustrated embodiment is moved upwardly, i.e., in the direction 80, forcing the cup 30 through a forming die 220. A hydraulically actuated hold down assembly 230 may be provided in the second stage 200 in order to hold and control the cup 30 during the reverse drawing process.

As shown in FIGS. 3, 7 and 9 the second stage 200 may comprise a four post press having four vertically extending posts 202 mounted on the support platform 510 and extending downwardly therefrom. The mounting positions 201 of the vertical posts 202 are shown in FIG. 4. A ram plate or carriage 206 is slideably mounted on the vertical posts 202. In order to facilitate a relatively longer ram stroke length, the ram carriage 206 may be mounted on a rack and pinion gear assembly 208, FIG. 7, which may be actuated by servo motors 240 to move the ram carriage 206, and thus the ram 210, up 80 and down 70. After a cup 30 is mounted in the hold down assembly 230, the carriage 206 is moved upwardly, direction 80, from the lowered position shown in FIG. 7. At the end of this upward ram stroke the elongated cylinder 40 formed by the stroke is located above the platform 510 at position 250 and is oriented with the top edge 42 down.

The second stage hold down assembly 230 may include a hold down plate 232 that is slideably mounted on the vertical posts 202. The hold down assembly may also include a plurality of hydraulic cylinders 234 operably mounted on the support platform 510 and having pistons 235 extending through the platform 510 and attached to the hold down plate 232. Part of the hold down tooling may be affixed to the platform 510, extending downwardly therefrom. Another part of the hold down tooling may be mounted on the hold down plate 232. Conventional hold down tooling known in the art may be used. The plate 232 may be raised, direction 80, to hold the cup 30 during the ram stroke and may be lowered, direction 70, to disengage the formed elongated cylinder 40. The disengaged cylinder 40 is carried upwardly (direction 80) from hold down 230 by ram 210 and is deposited at location 250.

Figure 10:
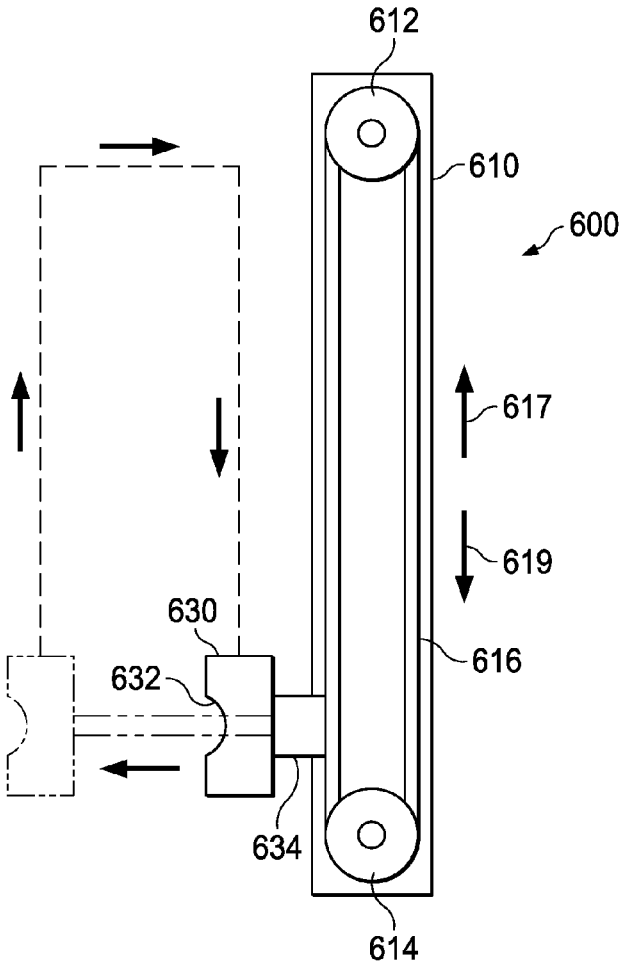
FIG. 10 is a schematic top view of a pick-and-place machine.

After the cylinder 40 has been formed and has been released and deposited by the ram 210 at location 250, it is picked up by a lateral transfer device, such as a pick-and-place assembly 600, FIG. 10, that moves it along path 603 to the third stage 300 in a top edge 42 down orientation, i.e., it is not flipped over during the transfer process from the second stage 200 to the third stage 300. By redrawing the work piece twice less redraw force is needed for each redraw stoke than in a conventional single redraw stroke container forming apparatus.

Figure 8:
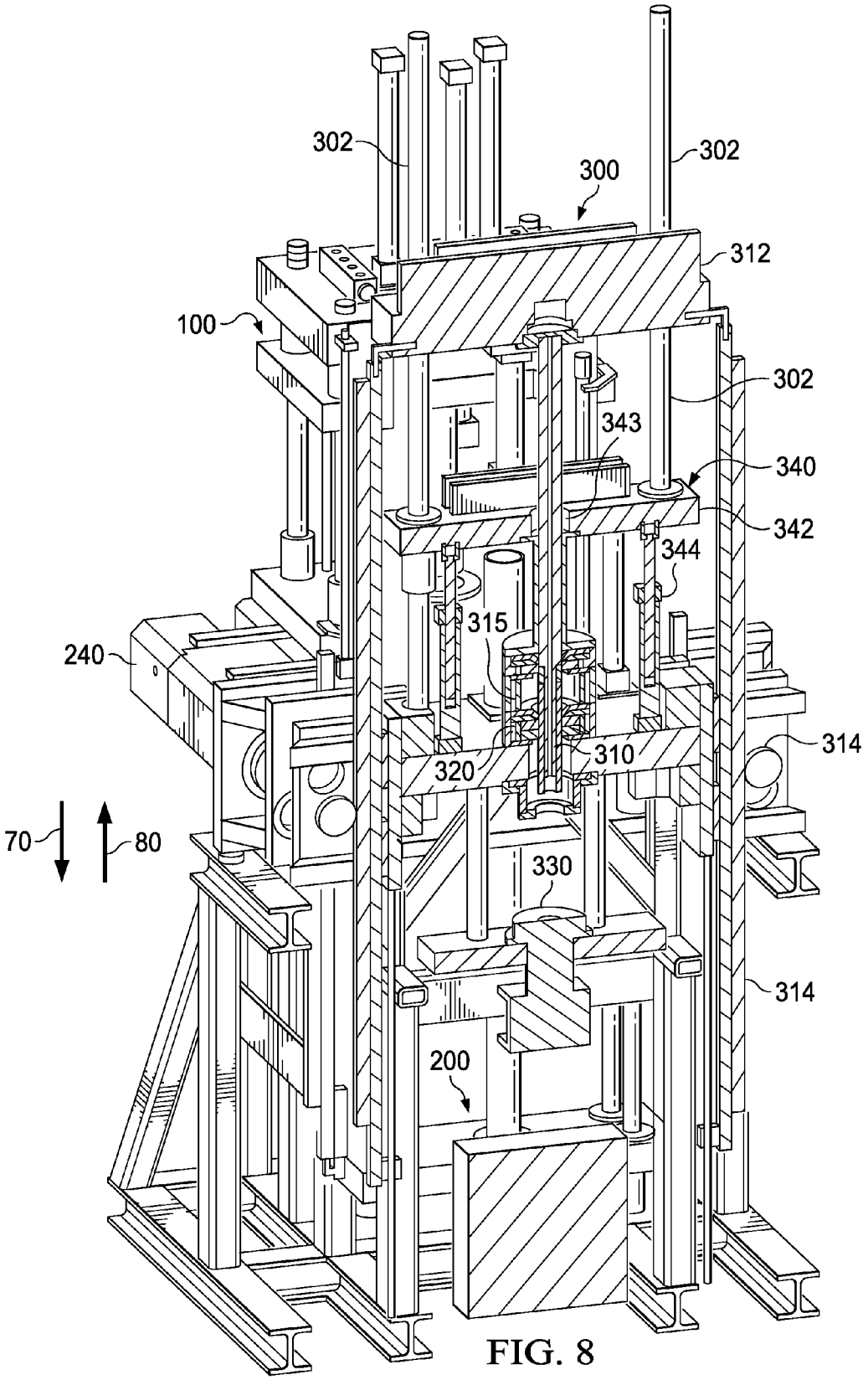
FIG. 8 is a side perspective cross-sectional detail view, looking back toward the first two stages, of the third stage of the example container body forming apparatus of FIG. 1.

FIGS. 3, 8 and 9 illustrate the third stage 300 in further detail. FIG. 8 is a side cross sectional elevation view of the third stage 300 that looks back towards the first and second stages 100, 200. With reference to FIGS. 3, 8 and 9, the third stage 300 may include a ram 310. After the elongated cylinder 40 is formed in the second stage 200, in a manner as described above, the elongated cylinder 40 may be conveyed laterally along path 603, to a location 308 in the third station 300 in alignment with the vertical path 311, FIG. 3, of ram 310, FIGS. 8 and 9. The ram 310 is used to reverse draw and iron the elongated cylinder into a cylindrical container body 50. To perform this operation, the ram 310 may be moved downwardly (i.e., in the direction 70), redrawing the medium length elongated cylinder 40 through a redraw die 315. Continued downward movement of the ram 310 causes the now redrawn cylinder to be forced through a series of ironing dies located within a toolpack 320, FIG. 9. Forcing the redrawn cylinder through the ironing dies in this manner causes the wall thickness of the cylinder to be reduced. Finally, after the redrawn and ironed cylinder exits the toolpack 320, it may be urged into contact with a doming apparatus 330 in order to form a conventional, downwardly concave dome 58, FIG. 2, in the closed end portion 52 of the cylindrical container 50. In this manner, the third stage 300 receives an elongated cylinder 40 and forms it into a redrawn and ironed cylindrical container body 50. A hydraulically actuated hold down assembly 340 may be provided in the third stage 300 in order to hold and control the elongated cylinder 50 during the reverse drawing and ironing process.

The third stage 300, like the first and second stages may comprise a four post press including four vertically extending posts 302, FIG. 8. The posts 302 may be attached to and extend upwardly from the platform 510 at 301 as shown in FIG. 4. The hold down assembly 340 may comprise a hold down plate 342 that is slideably mounted on posts 302. The ram 310 may pass through a hole 343 in plate 342. Hydraulic cylinders 344 may be mounted on platform 510 and attached to hold down plate 342 to move it downwardly, 70, to engage and hold the cylinder 40 during the redrawing and ironing ram stroke. The plate 342 may then be moved upwardly to release the drawn and ironed container 50 enabling it to be carried downwardly by the ram 310 to the doming apparatus 330 which may comprise a conventional doming die.

Ram 310 may be mounted on a ram plate or carriage 312 that is slideably mounted on posts 302. The carriage may be mounted to a rack and pinion assembly 314 that is driven by servo motors 316, FIGS. 1 and 3, to move the carriage 312 and thus the ram 310 upwardly 80 or downwardly 70. The rack and pinion arrangement facilitates a large ram stroke length required for the redraw and ironing and doming operation and to accommodate entrance of the relatively long cylinder 40 and the exit of the relatively longer domed cylindrical container 50.

After the doming operation is completed the ram 310 is withdrawn from the domed cylindrical container body and it is engaged and transferred, top edge 52 up, as by a pick-and-place machine 600, FIGS. 9 and 10, to the fourth stage 400 for trimming. The pick-and-place machine 600 is positioned at a location 605 adjacent to the doming apparatus 330 and an entry point 404 to the fourth stage 400, FIG. 9.

As best seen in FIG. 9, the fourth stage 400 may include a trimming device 410 configured to trim the cylindrical container body to the desired height.

With reference to FIG. 10, one embodiment of a pick-and-place machine 600 will now be described. A pick-and-place machine like 600 may be used for linear transfer of work pieces from each stage to the next succeeding stage. The pick-and-place machine 600 may have an elongated housing 610 having a first gear or pulley 612 at one end thereof and a second gear or pulley 614 at a second end thereof. A drive belt or chain 616 is operatively mounted on the gears/pulleys 612, 614. The gears/pulleys may be actuated by an attached servo motor (not shown) to move the belt/chain 616 in a first direction 617 or an opposite second direction 619. A work piece displacement member 630, which may have a concave surface 632 adapted to engage a work piece, e.g. 30, 40, 50, 60, is connected to a vacuum source (not shown). The vacuum source may be applied to selectively hold a work piece to the member 630 and may be terminated to release the work piece. The work piece displacement member 630 may be mounted on a controllably extendable and retractable arm 634 which may, in turn, be attached to the drive belt/chain 616. The work piece displacement member 630 may be displaced outwardly from the initial position shown to a position next to a work piece. The vacuum may be applied to hold the work piece to the member 630 during a "picking" operation. Next the member 630 may be moved parallel to the housing 610 to transport the work piece from the exit point of one stage to the entrance point of the next stage, where the vacuum is released to "place" the work piece. The member 630 may then be moved back to its original position.

Figure 11:
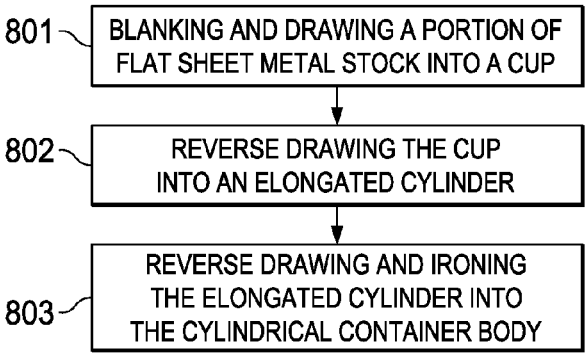
FIG. 11 is a flow chart of a method of forming a cylindrical container body.

A method of forming a cylindrical container body 50 having an open end 52 and an oppositely disposed closed end 54 is illustrated by the flow chart of FIG. 11. The method may include, as shown at block 801, blanking and drawing a portion of flat sheet metal stock 15 into a cup 30. The method further includes, as shown at block 802, reverse drawing the cup 30 into an elongated cylinder 40. The method also includes, as shown at block 803, reverse drawing and ironing the elongated cylinder 40 into the cylindrical container body 50.

The foregoing description of specific embodiments has been presented for purposes of illustration and description. The specific embodiments described are not intended to be exhaustive or to suggest a constraint to the precise forms disclosed, and many modifications and variations are possible in light of the above teaching. The illustrated embodiments were chosen and described in order to best explain principles and practical application, to thereby enable others skilled in the art to best utilize the various embodiments with various modifications as are suited to the particular use contemplated. It is intended that the scope of the invention be defined only by the claims appended hereto and their equivalents, except as limited by the prior art.

What is claimed is:

1. Apparatus for forming a single walled cylindrical container body having an open end and an oppositely disposed closed end, said apparatus comprising:

a first station adapted to blank and draw a portion of flat sheet metal stock into a cup having an open end and an oppositely disposed closed end, a first reciprocally movable ram located within said first station, said first reciprocally movable ram adapted to draw said portion of said flat sheet metal stock into said cup;

a second station adapted to reverse draw said cup into an elongated cylinder having an open end and an oppositely disposed closed end, a second reciprocally movable ram located within said second station, said second reciprocally movable ram adapted to reverse draw said cup into said elongated cylinder; and a third station adapted to reverse draw and iron said elongated cylinder having an open end and an oppositely disposed closed end into said single walled cylindrical container body having an open end and an oppositely disposed closed end, a third reciprocally movable ram located within said third station, said third reciprocally movable ram adapted to reverse draw and iron said elongated cylinder into said cylindrical container body.

2. The apparatus of claim 1 wherein said first station, said second station and said third station are all attached to a common support structure.

3. The apparatus of claim 1 and further comprising:

a fourth station adapted to trim said open end of said cylindrical container body.

4. The apparatus of claim 3 further comprising:

a first pick and place assembly adapted to transfer said cup, open end up, from said first station to said second station;

a second pick and place assembly adapted to transfer said elongated cylinder, open end down, form said second station to said third station, and a third pick and place assembly adapted to transfer said cylindrical container body, open end up from said third station to said fourth station.

5. The apparatus of claim 3 wherein said apparatus has a footprint of less than about 100 square feet.

6. The apparatus of claim 1 and further comprising:

a doming apparatus in said third station adapted to form a concave dome in said closed end of said cylindrical container body.

7. The apparatus of claim 1 and further comprising:

a first hold down assembly located within said first station, said first hold down assembly adapted to blank said portion of flat sheet metal stock and then hold said portion in place while said first reciprocally movable ram draws said portion of said flat sheet metal stock into said cup; and wherein both said first reciprocally movable ram and said first hold down assembly are hydraulically actuated.

8. The apparatus of claim 7 and further comprising:

a second hold down assembly located within said second station, said second hold down assembly adapted to hold said cup in place while said second reciprocally movable ram draws said cup into said elongated cylinder;

wherein said second hold down assembly is hydraulically actuated; and wherein said second reciprocally movable ram assembly is actuated by a rack and pinion system.

9. The apparatus of claim 1 wherein:

said first reciprocally movable ram is configured to move in a downward direction while drawing said portion of said flat sheet metal stock into said cup; and said second reciprocally movable ram is configured to move in an upward direction while reverse drawing said cup into said elongated cylinder.

10. The apparatus of claim 9 wherein said third reciprocally movable ram is configured to move in a downward direction while reverse drawing and ironing said elongated cylinder into said cylindrical container body.

11. The apparatus of claim 1 wherein said third reciprocally movable ram is adapted to cooperate with a doming apparatus located in said third station in order to form a concave dome in said closed end of said cylindrical container body.

12. A method of forming a cylindrical container body having an open end and an oppositely disposed closed end comprising:

blanking and drawing a portion of flat sheet metal stock into a cup;

reverse drawing said cup into an elongated cylinder; and reverse drawing and ironing said elongated cylinder into said cylindrical container body, wherein said blanking and drawing comprises moving a first ram in a first direction and wherein said reverse drawing said cup comprises moving a second ram in a second direction opposite said first direction.

13. The method of claim 12 wherein said reverse drawing and ironing said elongated cylinder comprises moving a third ram in said first direction.

14. The method of claim 13 further comprising:

noninvertingly laterally displacing the cup to a position above the second ram;

noninvertingly laterally displacing the elongated cylinder to a position below the third ram; and noninvertingly laterally displacing the cylindrical container to a position below a trimmer.

15. Apparatus for forming a cylindrical container body having an open end and an oppositely disposed closed end, said apparatus comprising:

a first station adapted to blank and draw a portion of flat sheet metal stock into a cup, a first reciprocally movable ram located within said first station, said first reciprocally movable ram adapted to draw said portion of said flat sheet metal stock into said cup said first reciprocally movable ram being configured to move in a downward direction while drawing said portion of said flat sheet metal stock into said cup, a first hold down assembly being located within said first station, said first hold down assembly being adapted to blank said portion of flat sheet metal stock and then hold said portion in place while said first reciprocally movable ram draws said portion of said flat sheet metal stock into said cup, both said first reciprocally movable ram and said first hold down assembly being hydraulically actuated;

a second station adapted to reverse draw said cup into an elongated cylinder having an open end and an opposite closed end, a second reciprocally movable ram located within said second station, said second reciprocally movable ram adapted to reverse draw said cup into said elongated cylinder, said second reciprocally movable ram being configured to move in an upward direction while reverse drawing said cup into said elongated cylinder;

a third station adapted to reverse draw and iron said elongated cylinder into said cylindrical container body, a doming apparatus in said third station adapted to form a concave dome in said closed end of said cylindrical container body, a third reciprocally movable ram located within said third station, said third reciprocally movable ram adapted to reverse draw and iron said elongated cylinder into said cylindrical container body, a second hold down assembly being located within said second station, said second hold down assembly adapted to hold said cup in place while said second reciprocally movable ram draws said cup into said elongated cylinder, said second hold down assembly being hydraulically actuated, said second reciprocally movable ram assembly being actuated by a rack and pinion system, said third reciprocally movable ram being configured to move in a downward direction while reverse drawing and ironing said elongated cylinder into said cylindrical container body; and a fourth station adapted to trim said open end of said cylindrical container body; wherein said first station, said second station and said third station and said fourth station are all attached to a common support structure.

16. The apparatus of claim 15, further comprising:

a first pick and place assembly adapted to transfer said cup, open end up, from said first station to said second station;

a second pick and place assembly adapted to transfer said elongated cylinder, open end down, form said second station to said third station, and a third pick and place assembly adapted to transfer said cylindrical container body, open end up from said third station to said fourth station.

17. The apparatus of claim 16 wherein said apparatus has a footprint of less than about 100 square feet.

* * * * *